United States Patent [19]

Ikesugi et al.

[11] Patent Number: 4,778,403

[45] Date of Patent: Oct. 18, 1988

[54] ZERO INSERTION FORCE CONNECTOR

[75] Inventors: Hiroshi Ikesugi; Naoki Hayashi, both of Yokohama, Japan

[73] Assignee: Elco Corporation, Newport Beach, Calif.

[21] Appl. No.: 73,600

[22] Filed: Jul. 15, 1987

[51] Int. Cl.[4] ..... H01R 9/11

[52] U.S. Cl. ..... 439/329; 439/499

[58] Field of Search ..... 439/67, 77, 260, 267, 439/329, 492–499

[56] References Cited

U.S. PATENT DOCUMENTS

| | | | |
|---|---|---|---|
| 3,088,090 | 4/1963 | Cole et al. | 439/495 |
| 3,149,896 | 9/1964 | Hall | 439/77 |
| 3,701,071 | 10/1972 | Landman | 439/329 |
| 4,456,318 | 6/1984 | Shibata et al. | 439/68 |
| 4,630,874 | 12/1986 | Renn et al. | 439/67 |
| 4,639,063 | 1/1987 | Mueller | 439/493 |

FOREIGN PATENT DOCUMENTS

| | | | |
|---|---|---|---|
| 2323914 | 11/1973 | Fed. Rep. of Germany | 439/495 |

*Primary Examiner*—J. Patrick McQuade

*Attorney, Agent, or Firm*—Hoffmann & Baron

[57] ABSTRACT

A zero insertion force connector assembly is provided for allowing the electrical connection of a flat, flexible cable having conductors therein and a printed circuit board. The assembly includes a plastic housing having spring contacts arranged in parallel configuration. The housing is secured to the printed circuit board by the tail ends of the spring contacts. A cover plate is pivotably and slidably mounted to the housing. An end of the cable may be inserted between the cover and housing when the cover plate is pivoted to an oblique position with respect to the housing. The cover plate is then pivoted towards the contacts and moved rearwardly to lock it in the closed position. The housing and cover plate include mutually engaging components which effect such locking upon sliding the cover plate towards the housing.

18 Claims, 8 Drawing Sheets

FIG. 7
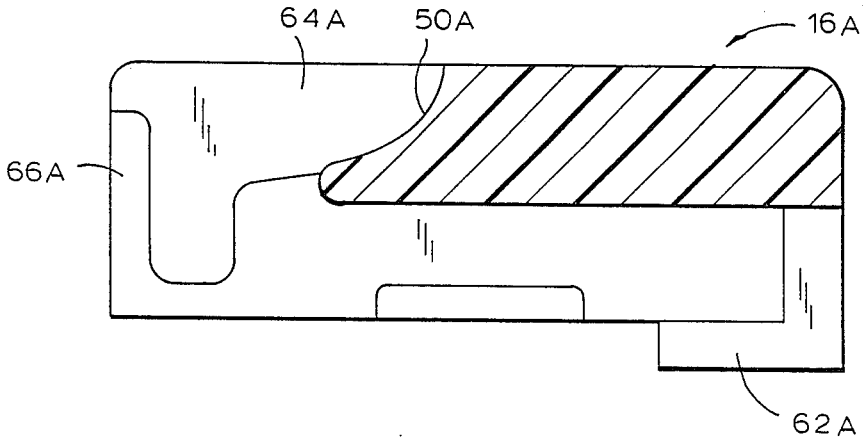
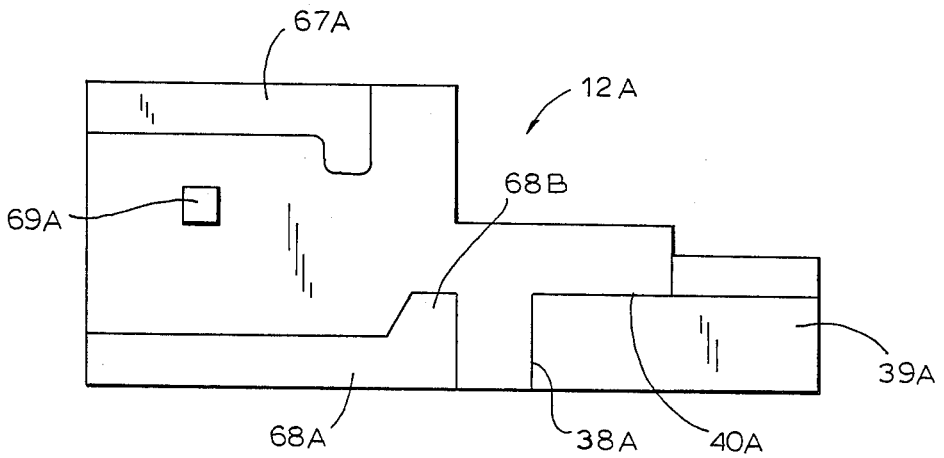
FIG. 8

FIG. 9A
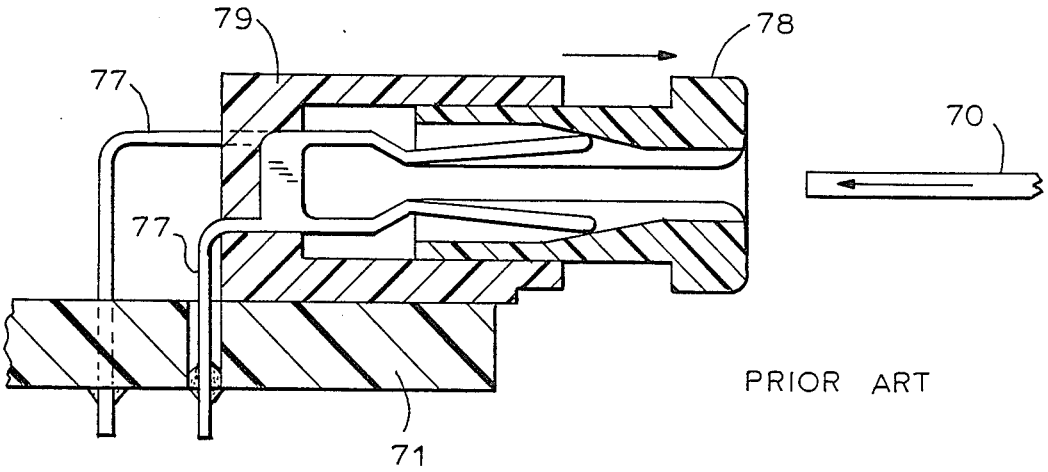
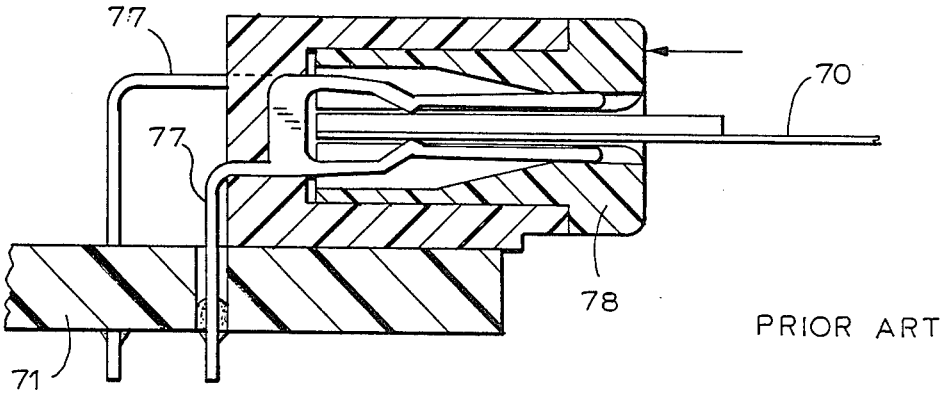
FIG. 9B

FIG. 10A
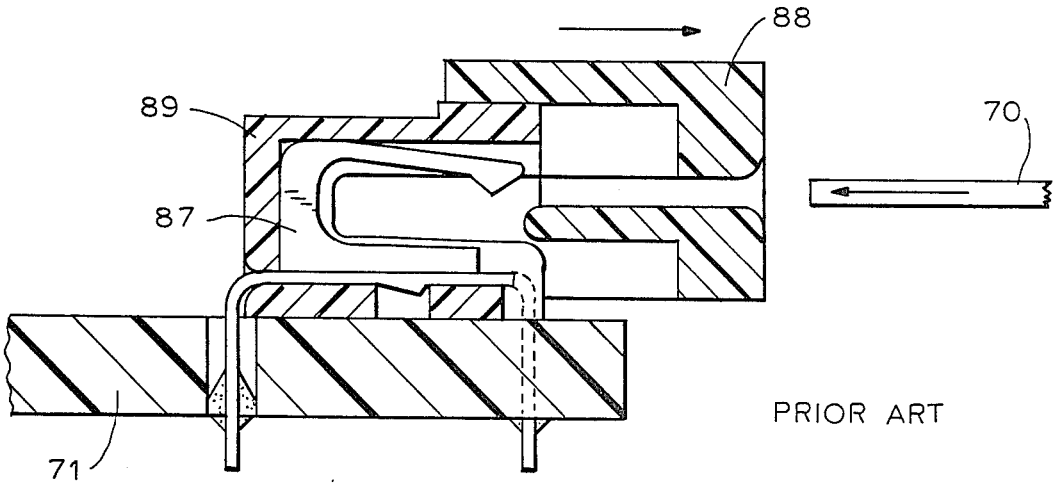
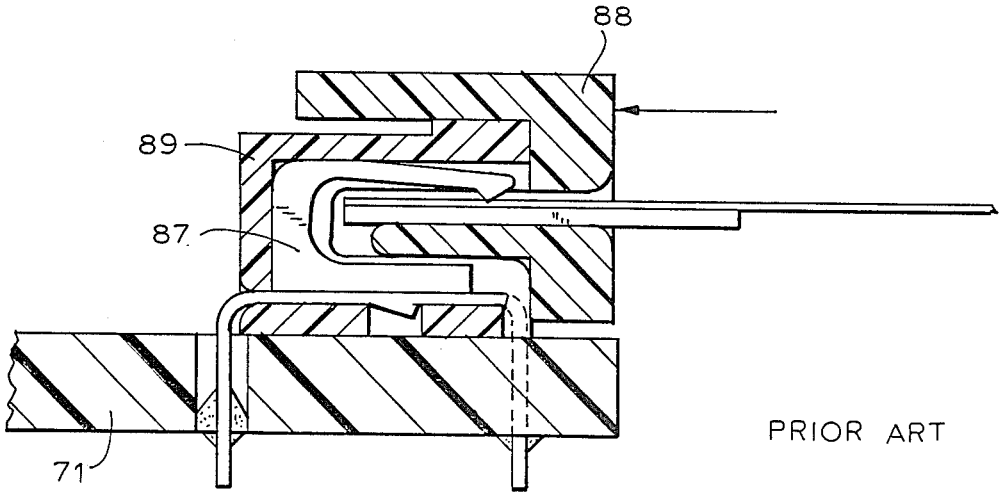
FIG. 10B

FIG. 11A
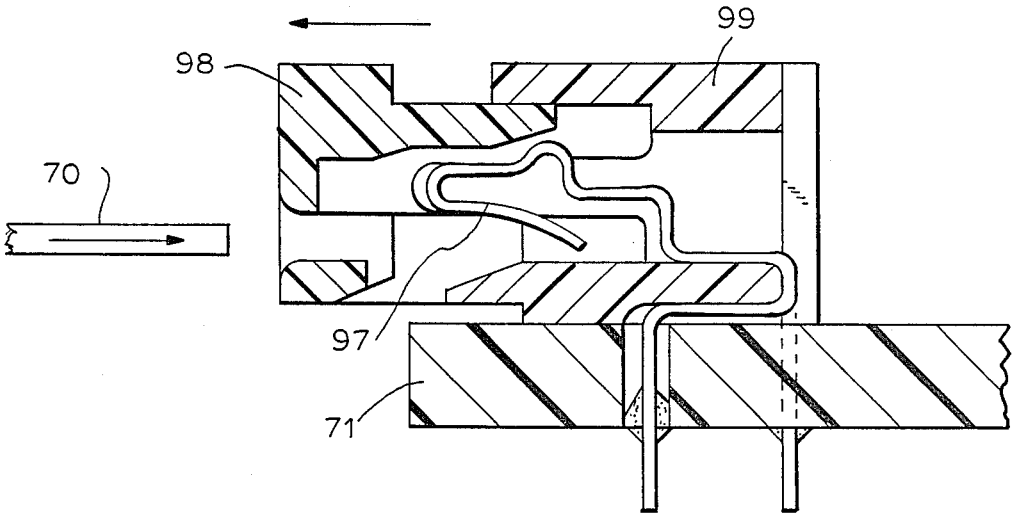
PRIOR ART
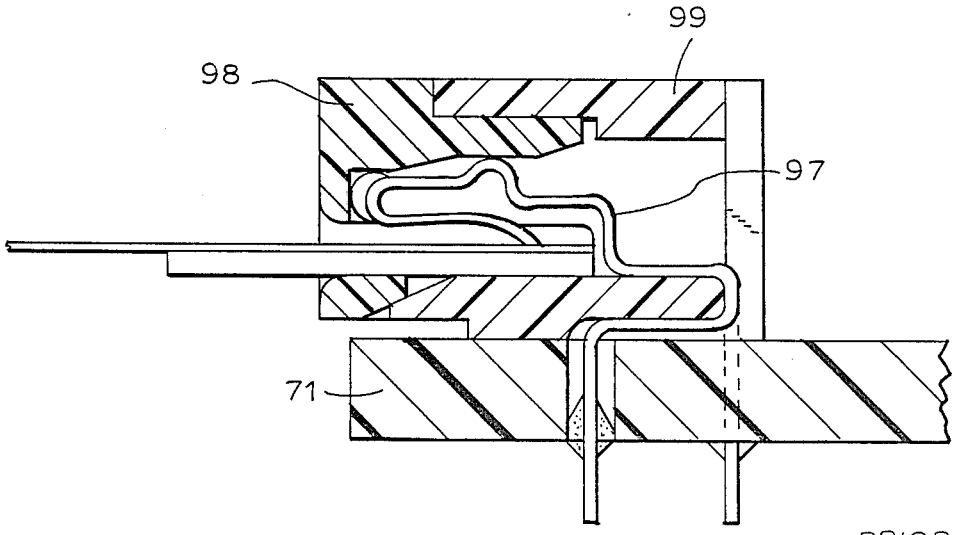
PRIOR ART
FIG. 11B

ZERO INSERTION FORCE CONNECTOR

BACKGROUND OF THE INVENTION

1. Field of the Invention

This invention relates to a zero insertion force (ZIF) connector.

2. Brief Description of the Prior Art

In order to facilitate an electrical connection between a thin conductor such as a flat, flexible printed cable and an element such as a conventional printed circuit board, various types of zero insertion force connectors have been suggested. FIGS. 9A–11B show various miniaturized prior art zero insertion force connectors used in conjunction with flexible cables. In these figures, FIGS. 9A–11A show ZIF connectors before the end of a flexible cable is inserted in the ZIF connector, and FIGS. 9B–11B show the ZIF connector after the connection is completed. In these ZIF connectors shown herein, slider 78, 88 or 98 is inserted in the cavity of the connector housing 79, 89 and 99 along with the flexible cable in a direction parallel to the surface of the printed circuit board 71. The slider is then pushed into the cavity of the connector so as to engage spring contact 77, 87, or 97 with the inner wall thereof. Electrical and mechanical connections between the flexible cable 70 and the spring contacts are thereby established.

The tendancy towards miniaturization of all electrical components has created an ever increasing demand for miniaturized connectors. As shown in FIGS. 9A–11B, the ZIF connectors used with flexible cables in prior art assemblies have structures wherein the ceiling portion of the connector and the ceiling portion of the slider are overlapped and slide along each other so as to urge the spring contacts in a desired direction. Therefore, if one tries to reduce the total height of such a connector, the thickness(es) of the sliding portion of the slider and/or connector must be reduced. However, such reduced thickness would seriously affect the mechanical strength of the connector. This creates a significant problem when attempting to decrease the height of previously known zero insertion force connectors used to connect flat, flexible cable to printed circuit boards.

SUMMARY OF THE INVENTION

It is, therefore, an object of the invention to provide a novel thin type zero insertion force multiple connector by which a significant reduction of the total height of a zero insertion force connector can be attained.

A connector according to the invention includes a body portion, spring contacts secured to the body portion, and a plate mounted to the body portion for urging the conductors of a flat, flexible cable or the like against the contact portions of the spring contacts. The plate is pivotably and slidably mounted to the body portion. It preferably includes guide means for guiding the end of the flat, flexible cable towards the contacts. The body portion and plate include mutually engaging locking means for locking the plate, and accordingly the flexible cable, in position.

BRIEF DESCRIPTION OF THE DRAWINGS

FIG. 7 is a sectional elevation view of a cover plate according to a second embodiment of the invention;

FIG. 8 is a side elevation view of an insulating housing according to a second embodiment of the invention; and FIGS. 9–11B are sectional views illustrating zero insertion force connectors known to the art.

DETAILED DESCRIPTION OF THE INVENTION

Figure 1:
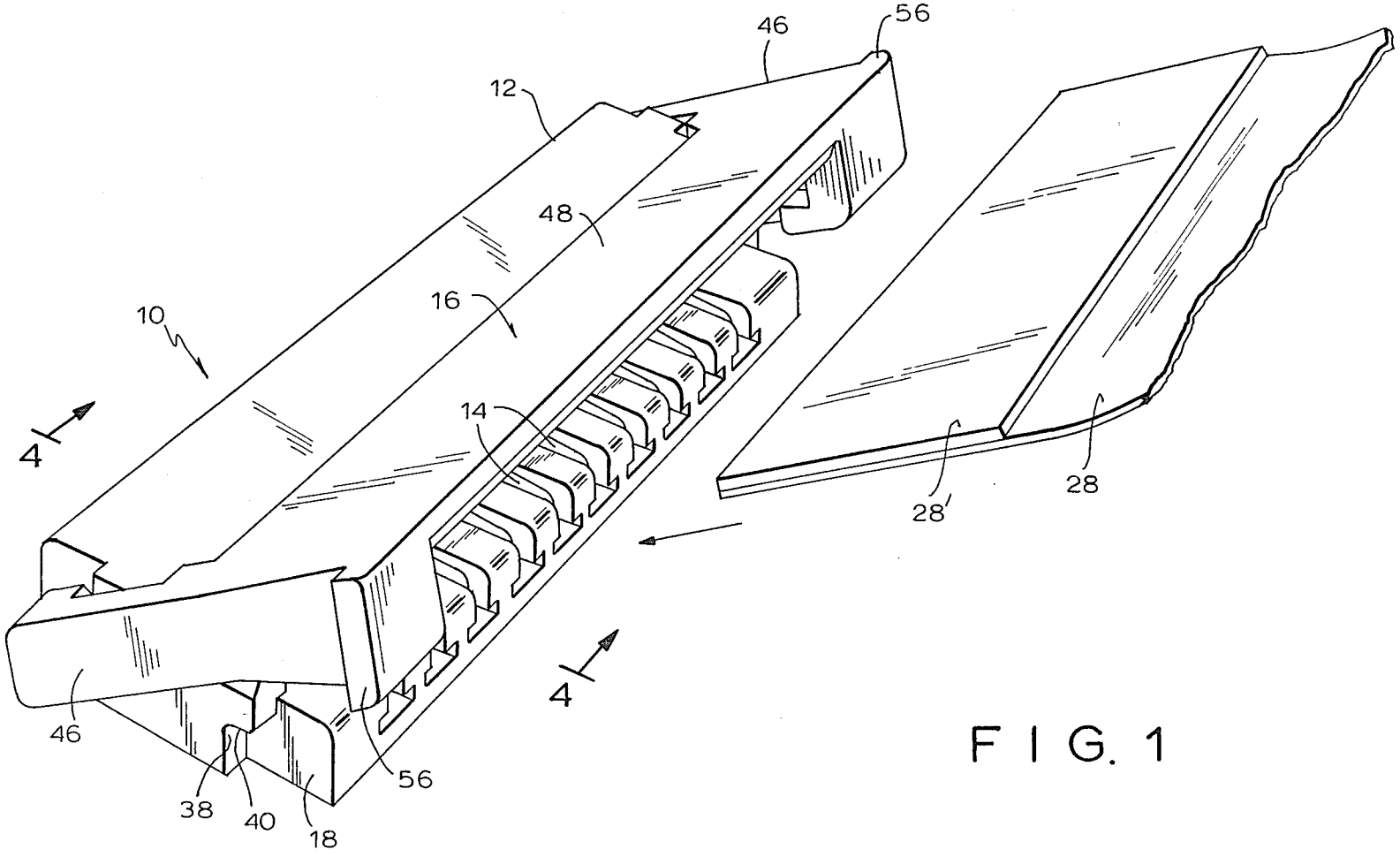
FIG. 1 is an enlarged, perspective view of a miniaturized zero insertion force connector assembly in accordance with the invention.
Figure 2:
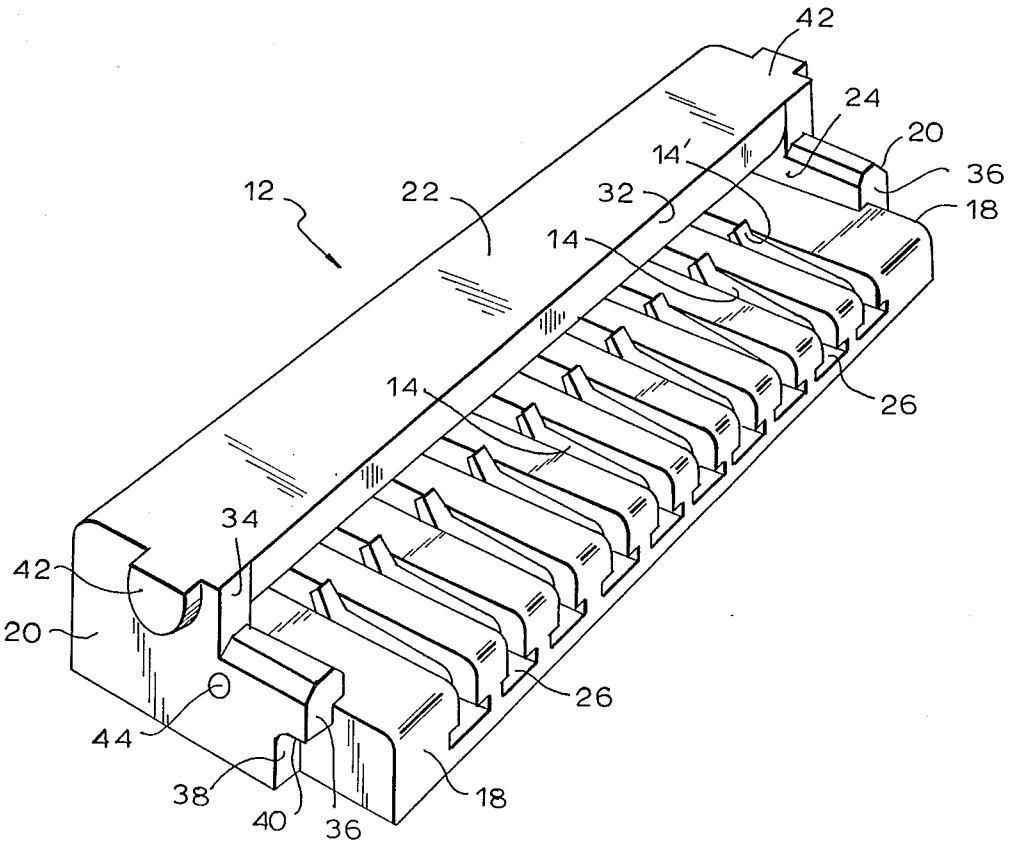
FIG. 2 is an enlarged, perspective view of an insulating housing employed with the connector assembly shown in FIG. 1.
Figure 3:
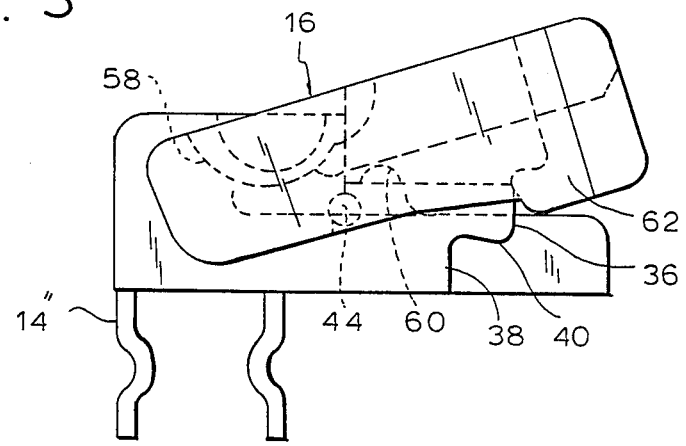
FIG. 3 is a side elevation view of the connector assembly shown in FIG. 1.
Figure 4:
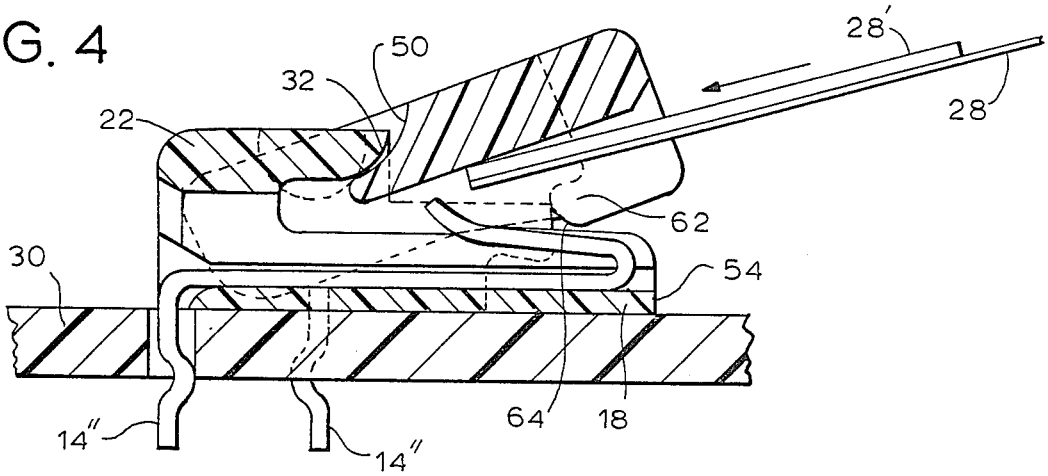
FIG. 4 is a sectional view of the connector assembly taken along line 4—4 of FIG. 1.
Figure 5:
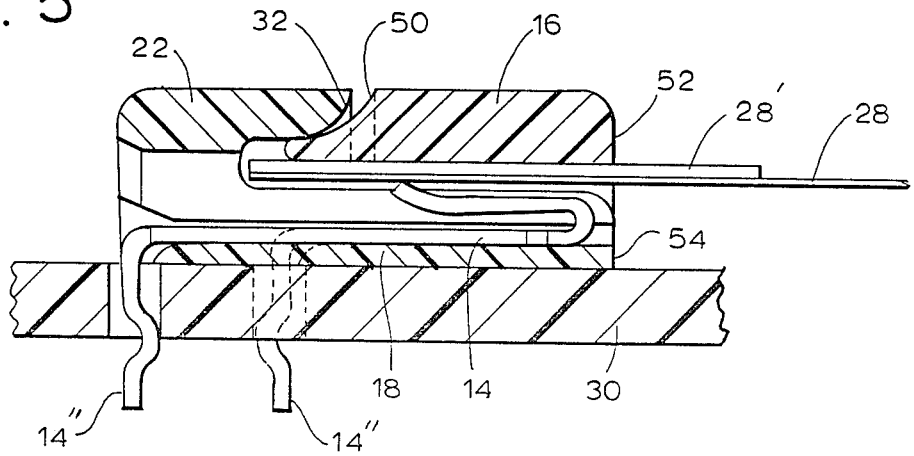
FIG. 5 is a sectional view of the connector assembly illustrating the cover plate in the closed position.
Figure 6:
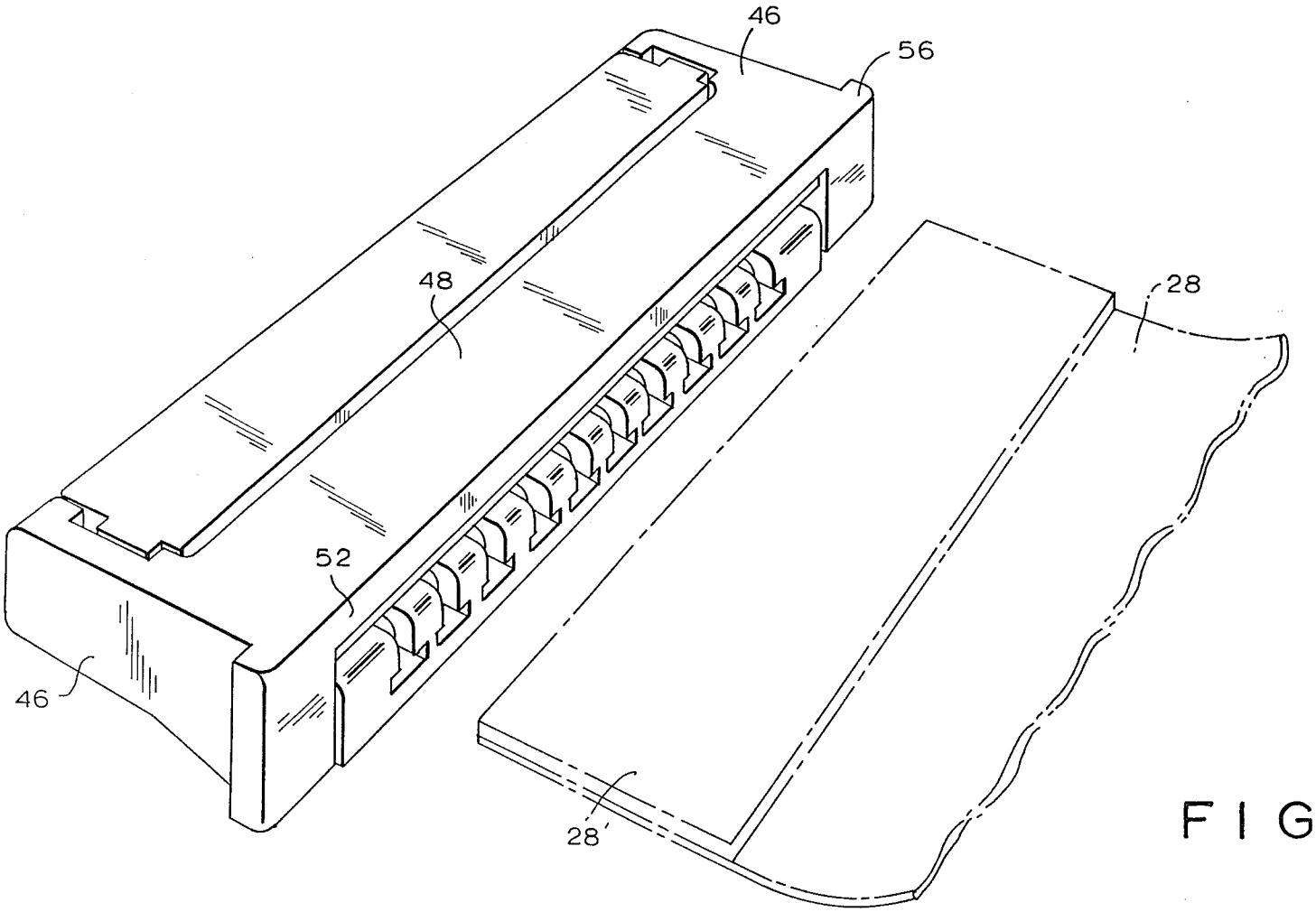
FIG. 6 is an enlarged perspective view of the connector assembly illustrating the cover plate in the closed position.

Referring to the drawings, FIG. 1 illustrates a zero insertion force connector assembly 10 including an insulator housing 12, spring contacts 14 and a cover plate 16. The housing 12, which is best shown in FIG. 2, is of unitary, plastic construction and comprises a bottom portion 18, a pair of side walls 20, and a top wall 22. A space 24 is defined by the bottom portion, side walls and top wall. The bottom portion 18 includes ten slots 26 having reversed T-shaped configurations. The spring contacts 14 are mounted within the slots. Each includes a U-shaped end portion 14' which forms the contact portion for making an electrical connection with the end portion 28' conductors of a flat, flexible cable 28. The contact portions project above the upper surface of the bottom portion 18. As shown in FIGS. 3–5, the other ends of the spring contacts define solder tails 14'' which are inserted into the holes of a printed circuit board 30. The bottom portion 18 of the housing 12 is supported by the board and may or may not be in direct contact with it.

Referring to FIGS. 4–5, it can be seen that the length of the top wall 22 is less than half the length of the bottom portion 18. In other words, the rear ends of the bottom portion and top wall define the rear end of the insulator housing while the front end thereof is defined by only the front end of the bottom portion. The contact portions 14' are thereby exposed. The front end of the top wall 22 includes a convex lower surface 32.

As shown in FIG. 2, each of the front end portions of the side walls 20 includes a first vertical planar surface 34, a second vertical planar surface 36 located between planes defined by the first planar surface 34 and the front edge of the bottom portion 18, and a third vertical planar surface 38 located between the first and third planar surfaces. The second and third planar surfaces and the surface 40 connecting them define a locking step. The inner surfaces of the side walls are substantially flat. The outer surfaces thereof each include a semicircular lateral projection 42 and a cylindrical projection 44 positioned below and forward of the semicircular projection.

The cover plate 16 is pivotably and slidably mounted to the housing 12 as shown in FIGS. 1 and 3–6. It includes a pair of opposing side walls 46 connected by an integral cross member 48. Referring to FIG. 4, the entire rear edge of the cross member 48 is defined by an upwardly facing concave surface 50. This concave surface engages the convex surface 32 defined by the front end of the top wall 22 of the insulator housing 12. The upper and lower surfaces of both the cover plate and the top wall 22 of the insulator housing are preferably in the same respective planes as shown in FIG. 5. The radius of curvature of the concave surface 50 is greater than that of the corresponding convex surface 32 of the top wall 22. The front ends 52,54 of the cover plate and housing, respectively, are in substantially the same vertical plane when the connector assembly 10 is in use. A pair of lateral projections 56, which may include serrations (not shown) therein, extends from the cross member to facilitate the maneuverability of the cover plate 16 with respect to the housing 12.

FIG. 3 is illustrative of the manner in which the cover plate 16 is secured to the housing 12. A recess 58 is defined within the inner surface of each side wall 46 of the cover plate. The semicircular projection 42 is positioned loosely within this recess and prevents the cover plate from being disassociated with the housing. This also allows the concave surface 50 of the cover plate to slide easily with respect to the convex surface of the housing. The cover plate may accordingly be moved from the oblique position shown in FIG. 4 to the closed position shown in FIG. 5. The cylindrical projection 44 is positioned within a second recessed area 60 to prevent overstressing of the cover plate when maneuvered with respect to the housing.

An L-shaped projection or shoulder 62 extends from the front portion of the inner surface of each side wall 46 of the cover plate 16. The inner surface 64 of the projection contacts the outer surface 36 of the housing to restrict the pivotability of the cover plate. The interaction of the semicircular projection 42 and recess 58 also prevent excessive displacement which could cause disassociation of the cover plate from the insulator housing.

The connector assembly 10 is utilized by pivoting the cover plate 12 away from the contact 14 as shown in FIG. 4. The reinforced end 28' of the flat, flexible cable is then inserted between the side walls 46 of the cover plate which guide the cable to the proper position where the conductors (not shown) within the cable are aligned with the spring contacts. The cover plate is then pushed against the contacts which exert an opposing force against the plate. The engaging convex and concave surfaces 32,50 act as the fulcrum of a lever during this procedure. When the upper surfaces of the insulator housing and the cover plate are substantially coplanar, the forces exerted on the convex and concave surfaces are relatively high. The cover plate is then pushed towards the rear of the insulator housing which results in the engagement of the locking step (38,40) with the L-shaped projection 62 of the cover plate. FIG. 5 shows the connector assembly in this locked position.

The flexible cable 28 may be removed by reversing the above steps. Using the lateral projections 56 of the cover plate 16, the cover plate is pulled towards the front of the connector assembly where it may be pivotably moved to an oblique position with respect to the insulator housing. The cable is then easily removed. The pivotable cover plate greatly facilitates making connections between a printed circuit board and a multi-conductor, flat, flexible cable, particularly where the connector assembly is mounted centrally upon the board.

FIGS. 7 and 8 illustrate an alternative, somewhat preferred arrangement whereby a cover plate 16A may be secured to an insulator housing 12A. The cover plate includes a concave surface 50A which engages a convex surface (not shown) of the housing as described with respect to the embodiments shown in FIGS. 1–6. An L-shaped projection 62A is provided on the cover plate for engaging with a pair of surfaces 38A,40A on the housing. These surfaces are defined by a recessed area 39A within each outer side wall of the housing.

A depression 64A formed within the inner wall of the cover plate defines an upwardly extending projection 66A. A pair of substantially L-shaped projections 67A,68A extend laterally from the side walls of the insulator housing. A smaller set of projections 69A also extend laterally from the side walls. These smaller projections do not project nearly as far as the L-shaped projections from the side walls of the housing.

In use, the upwardly extending projections 66A of the cover plate 16A are positioned behind the shoulders defined by the upper L-shaped projection 67A of the housing. When positioned forwardly of the small projection 69A, the inclined surface of the lower shoulder 68B allows the cover plate to be pivoted about an axis running through the upper portions of projections 66A. These projections 66A "snap" over the small projections 69A to lock the cover plate in the closed position. As this occurs, the L-shaped projections 62A on the inner walls of the cover plate engage surfaces 38A,40A to prohibit pivotal movement.

We claim:

1. A connector assembly comprising:

a housing;

a plurality of spring contacts secured to said housing, said housing including a top wall positioned above said spring contacts;

a cover plate pivotably mounted to said housing, said cover plate being pivotably movable towards or away from said spring contacts, said cover plate including a pair of opposing side walls connected by a cross member, said cross member including a rear surface having a concave section; and said top wall of said housing including a front edge adjoining said rear surface of said cover plate.

2. A connector assembly as defined in claim 1 including means for allowing said cover plate to move linearly as well as pivotably with respect to said housing.

3. A connector assembly as defined in claim 2 including locking means for preventing said cover plate from being pivoted away from said spring contacts.

4. A connector assembly as defined in claim 3 wherein said locking means prevents said cover plate from being pivoted away from said spring contacts when said cover plate is in a first position with respect to said housing, but allows such pivotal movement when said cover plate is displaced a selected linear distance from said first position.

5. A connector assembly as defined in claim 4 wherein said locking means include an inverted step defined by said housing and a shoulder defined by said cover plate which engages said inverted step.

6. A connector assembly as defined in claim 1 wherein said front edge of said top wall has a convex cross section.

7. A zero insertion force connector assembly comprising:

a housing including a bottom portion, a pair of side walls connected to said bottom portion, a top wall extending between said side walls, and a space defined by said bottom portion, side walls, and top wall;

a plurality of contacts mounted to said bottom portion;

a cover plate pivotably and slidably mounted to said housing, said cover plate being pivotable towards and away from said contacts and slidable between first and second positions; and locking means for preventing pivotal movement of said cover plate when said cover plate is in said second position.

8. A connector assembly as defined in claim 7 wherein said cover plate includes a pair of opposing side walls pivotably secured, respectively, to said side walls connected to said bottom portion.

9. A connector assembly as defined in claim 8 wherein said top wall of said housing includes a front edge portion having a convex cross section; said cover plate includes a cross member connected to said opposing side walls, said cross member including a rear surface having a concave cross section, said convex edge portion of said top wall of said housing adjoining said concave rear surface of said cross member.

10. A connector assembly as defined in claim 7 wherein said locking means include an inverted step defined by said housing and a shoulder defined by said cover plate which engages said inverted step when said cover plate is in said second position.

11. A connector assembly as defined in claim 7 wherein said contacts are spring contacts mounted substantially parallel to each other.

12. A connector assembly as defined in claim 7 wherein said space has a substantially rectangular opening.

13. A connector assembly as defined in claim 8 wherein each of said side walls of said housing includes an exterior surface having a pair of opposing L-shaped, lateral projections extending therefrom, said side walls of said cover plate each including a projection extending from an interior surface thereof and positioned between one of said pairs of opposing L-shaped, lateral projections.

14. A connector assembly comprising:

a housing including a bottom portion, a pair of side walls connected to said bottom portion, a top wall extending between said side walls, there being a space defined by said top wall, side walls and bottom portion of said housing;

a plurality of spring contacts secured to said bottom portion of said housing; and a cover plate pivotably mounted to said housing, said cover plate including a pair of opposing side walls pivotably secured, respectively, to said side walls connected to said bottom portion of said housing, said cover plate being pivotably movable towards or away from said spring contacts.

15. A connector assembly as defined in claim 14 wherein said top wall of said housing includes a front edge which is convex in cross section, said cover plate including a cross member connecting said opposing side walls thereof, said cross member having a rear surface which is concave in cross section, said rear surface of said cross member being in adjoining relation to said front edge of said top wall of said housing.

16. A connector assembly as defined in claim 14 including means for slidably mounting said cover plate to said housing.

17. A connector assembly as defined in claim 14 including means for locking said cover plate in a closed position with respect to said housing.

18. A connector assembly as defined in claim 14 wherein said space has a substantially rectangular opening.

* * * * *